United States Patent [19]

DeFlander et al.

[11] Patent Number: 4,635,795

[45] Date of Patent: Jan. 13, 1987

[54] EASY-OPENABLE SEE-THROUGH CONTAINER

[75] Inventors: Jos DeFlander, Wespelaar; Dirk Verdoodt, Mechelen, both of Belgium

[73] Assignee: The Procter & Gamble Company, Cincinnati, Ohio

[21] Appl. No.: 767,458

[22] Filed: Aug. 20, 1985

[30] Foreign Application Priority Data

Oct. 12, 1984 [GB] United Kingdom ..... 84 25882

[51] Int. Cl.[4] ..... B65D 5/50; B65D 5/64

[52] U.S. Cl. ..... 206/526; 206/44 R; 206/45.31; 206/45.34; 206/631; 229/160

[58] Field of Search ..... 206/44 R, 45.31, 45.3, 206/631, 45.34, 526; 229/37 E, 160

[56] References Cited

U.S. PATENT DOCUMENTS

| | | | |
|---|---|---|---|
| 2,548,985 | 4/1951 | Lighter | 206/45.31 |
| 2,651,450 | 9/1953 | Ellsworth | 206/631 |
| 3,162,351 | 12/1964 | Rudofski | 206/586 |
| 3,784,082 | 1/1974 | Hurlock | 229/164 |
| 4,427,108 | 1/1984 | Coles et al. | 206/497 |

FOREIGN PATENT DOCUMENTS

| | | | |
|---|---|---|---|
| 157742 | 10/1985 | European Pat. Off. | 206/427 |
| 2819000 | 4/1978 | Fed. Rep. of Germany . | |
| 1416645 | 11/1964 | France . | |
| 1444032 | 5/1966 | France | 206/45.31 |
| 1501894 | 10/1967 | France | 229/37 E |
| 2488568 | 2/1982 | France | 229/43 |
| 110678 | 3/1961 | Pakistan | 206/45.31 |
| 481676 | 3/1938 | United Kingdom | 229/37 E |
| 2067519 | 7/1981 | United Kingdom | 206/44 R |

*Primary Examiner*—William Price
*Assistant Examiner*—Brenda J. Ehrhardt
*Attorney, Agent, or Firm*—Richard C. Witte; John V. Gorman; Ronald J. Snyder

[57] ABSTRACT

A shipping and display container featuring substantially open sidewall panels is described as including a body portion and a top panel attached to the body portion. The body portion further includes a bottom panel, front and rear sidewall panels attached to opposite front and rear edges of the bottom panel, right and left sidewall panels attached to opposite right and left edges of the bottom panel, and four reinforcing corner pillars. The front, rear, right and left sidewall panels have substantially open cutout portions from therein to provide see-through windows in the resulting container. The top panel is designed to be easily removeable from the container. This improved container unitarily provides adequate strength and protection for contained products while providing for convenient and substantial display characteristics.

11 Claims, 6 Drawing Figures

EASY-OPENABLE SEE-THROUGH CONTAINER

TECHNICAL FIELD

The invention relates to an improved shipping/display container, and, more particularly, to a shipping and display container which features substantially open cutout portions in its four sidewall panels, reinforcing pillars in its four corners, and a top-panel which can be easily removed from the container without use of any tools.

BACKGROUND OF THE INVENTION

Modern shipping, storing and displaying techniques in the packaging industry have made it desirable to be able to use a single container for all of these three product handling stages. The requirements to be fulfilled at each of these stages can, however, be quite different and sometimes even contradictory vis-a-vis container characteristics. Indeed, for shipping and storing, it is important that the containers provide strength for product protection and to permit stacking. At the displaying stage, strength and stackability are still important, but it is also highly desirable that the individual items packed within the containers be visible and accessible for price marking and for easy removal. Such visibility and product accessibility generally tends to result in a substantial loss of overall strength in the container. It is furthermore highly desirable that the containers be easily openable without a need for additional tools or substantial labor and/or time. All these requirements must be fulfilled without unduly increasing the cost of the container. None of the containers heretofore known in the industry could achieve all of these objectives simultaneously.

Increasing strength and, consequently, stackability of individual containers, without using stronger, more expensive material, has been achieved by building pillars in the four corners of a container, by appropriately folding part of the carton blank, as is described in French Pat. No. 1,416,645 filed by Cartiere di Verona on Nov. 4, 1964. Another version of containers with triangular reinforcing pillars is disclosed as the product of the machine covered by German OS No. 2,819,000 filed by Mecanica di Valenti Dante on Apr. 29, 1978.

Conventional shipping and display containers having one, two, three or four lateral side-panels showing a window cut-out allowing visibility of the individual items are available in the trade. None of these containers are, however, strong enough to allow a stacked display without additional reinforcing or supporting material. Furthermore, none of them is provided with a top-panel which can be removed by one pull of the hand to allow easy accessibility of the individual items packed for price marking or removing.

DISCLOSURE OF THE INVENTION

It is, therefore, an object of the present invention to provide a container which is strong enough to allow stacking during shipping, storing and displaying; which, at the same time, allows visibility of the contained product from four different sides; and which, following easy removal of the top-panel, allows convenient price-marking and/or removal of the individual products contained therein.

It is also an object of the invention to provide an improved shipping and display container which can be economically manufactured on automatic equipment.

Other objects and advantages of the invention will appear hereinafter.

In accordance with one aspect of the present invention, a shipping and display container featuring substantially open sidewall panels is disclosed as comprising a body portion including a bottom panel, two opposite front and rear sidewall panels, two opposite right and left sidewall panels, four reinforcing corner pillars, and an easily removable top panel. In a preferred embodiment, the two opposite right and left sidewall panels each include a top flap extension which, when folded over by 90° towards each other, serve as bases against which the top panel can be attached by means of, for example, adhesive or the like. The top panel preferably includes a top wall portion and a pair of top wall extensions hingedly attached along parallel fold lines to opposite front-and-rear edges thereof. When folded over by 90° the top wall extensions come to rest against the vertical outside surfaces of two opposite pairs of neighboring reinforcing pillars, forming the upper portions of the composite front and rear sidewall panels. In a preferred embodiment, the top wall extensions complete the frame of the open cutout portions of the two opposite front and rear sidewall panels, and link together the two opposite reinforcing pillars against which they are glued, thereby augmenting the overall strength of the container for shipping and storage. These top wall extensions can also serve as a starting point for easily tearing off the top panel, thereby substantially opening up at least two sides of the container at the display stage, and allowing convenient price-marking and/or removal of the individual products contained therewithin. These two top wall extensions provide the additional advantage of preventing the contained product from falling out of the container during transportation and can eliminate the need for additional stretch or shrink-wrapping.

It should be understood that while reference is made herein to two opposite front and rear sidewall panels, these two opposite front and rear sidewall panels are absolutely identical and can each, or both together, be considered front panels at the display stage. The front and rear sidewall panels are designated as composite panels since in a preferred embodiment they are established by several individual elements, as will be more evident from the description of the drawings hereafter.

BRIEF DESCRIPTION OF THE DRAWINGS

While the specification concludes with claims which particularly point out and distinctly claim the subject matter forming the present invention, it is believed the invention will be better understood from the following description, taken in conjunction with the accompanying drawings in which identical features in the several views are identically designated, and in which:

DETAILED DESCRIPTION OF THE INVENTION

Figure 1A:
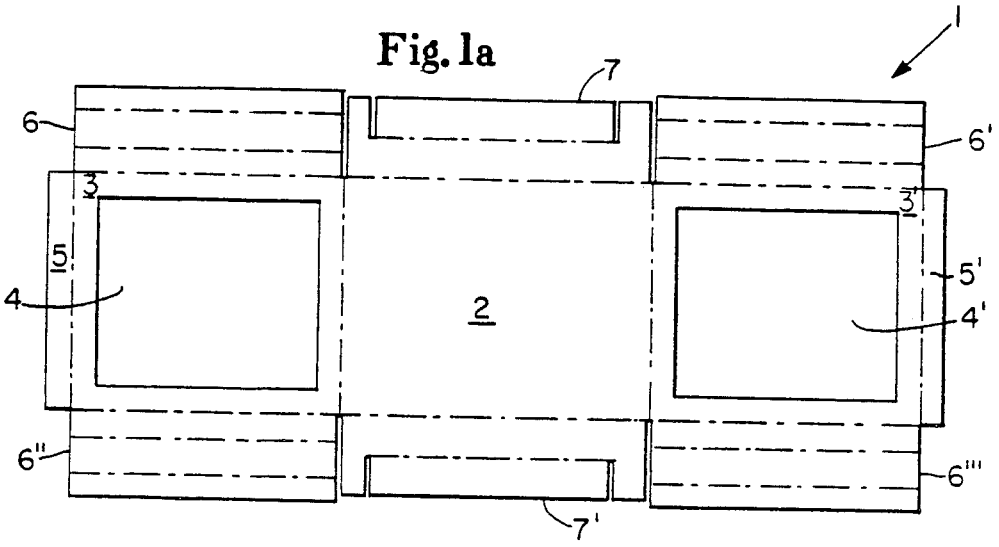
FIG. 1*a* is a plan view of the inner surface of a carton blank for the body portion of the most preferred embodiment of the container according to the present invention.

Referring to the drawings and detail, FIG. 1*a* illustrates carton blank 1 which forms the body portion 20 of a container made in accordance with the subject invention. Blank 1 is shown as including a substantially rectangular bottom panel 2, right and left sidewall panels 3 and 3' having substantial open portions or windows 4 and 4', respectively, top flap extensions 5 and 5' hingedly attached along the opposite distal edges of right and left sidewall panels 3 and 3', respectively, and front and rear sidewall panels 7 and 7' hingedly attached to the front and rear edges of bottom panel 2. Hingedly attached along the longitudinal edges of right and left sidewall panels 3 and 3' are a series of vertical members which, as will be described below, will be folded to create reinforcing pillars 6, 6', 6'' and 6'''.

Figure 1B:
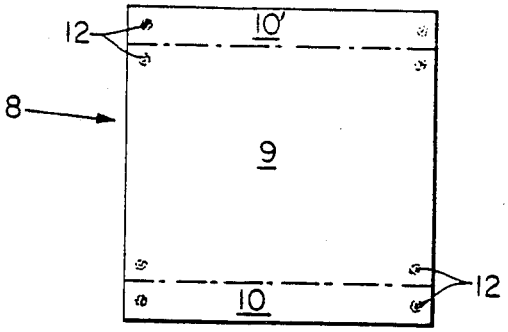
FIG. 1*b* is a plan view of the inner surface of the top panel for the container to be formed of the carton blank represented in FIG. 1*a;*

FIG. 1*b* illustrates top panel 8 of the subject container which further comprises top wall portion 9 having a pair of top wall extensions 10 and 10', respectively, hingedly attached along parallel fold lines to opposite front and rear edges thereof. FIG. 1*b* also illustrates the preferable placement of glue spots 12 for attaching top panel 8 to body portion 20 of the subject container. Such glue spots are shown only as a preferred example of a means of attaching the panel 8 in such a way as to provide relatively easy removal thereof.

Figure 2:
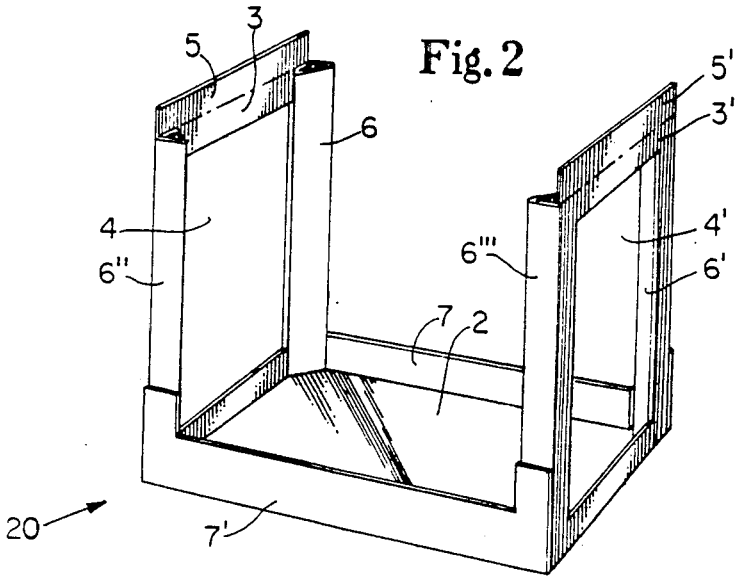
FIG. 2 is a perspective view of the erected and ready to be filled container formed from the carton blank of FIG. 1*a;*

In use, carton blank 1 is folded along the illustrated fold lines of FIG. 1*a* and erected to form body portion 20 of the subject container, as illustrated in FIG. 2. As can be seen from FIG. 2, the vertical members of reinforcing pillars 6, 6', 6'', and 6''', are folded inwardly to create a substantially triangular pillar in each of the four corners of the container body portion 20. As is also apparent from FIG. 2, the most distal vertical member of each pillar is folded into face-to-face relationship with a portion of the respective sidewall 3 or 3'. Following erection of the four corner pillars, front and rear sidewall panels 7 and 7' can be folded upwardly and attached to the outer surfaces of such pillars. Reinforcing pillars 6, 6', 6'' and 6''' thereby effectively hold the front, rear, right, and left sidewall panels in the positions shown in FIG. 2. Right and left sidewall panels 3 and 3' have been brought to vertical position, while front and rear sidewall panel 7 and 7' have also been folded upwardly 90° and attached to the outside surface of the reinforcing pillars. Top wall extensions 5 and 5' preferably remain in a substantially vertical position to more easily allow the product or products to be contained within the subject container to be placed therewithin. A more detailed description of a method and machine for erecting a container somewhat similar to body portion 20 shown in FIG. 2 can be found in the German reference OS No. 2,819,000.

Figure 3:
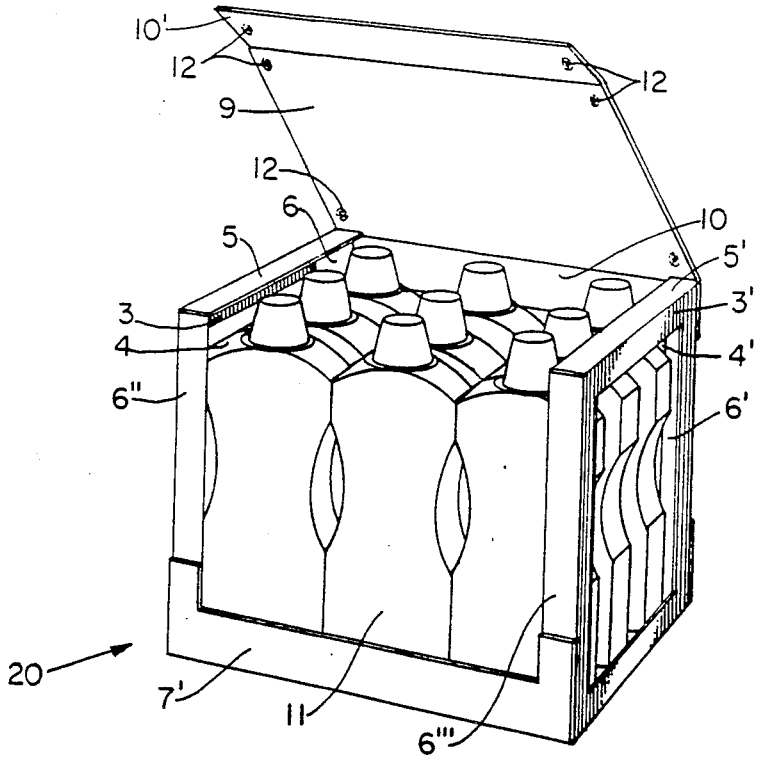
FIG. 3 is a perspective view of the container of FIG. 2 which has been filled with a plurality of products and on which the top panel of FIG. 1*b* has been partially attached.

Once the product to be contained is placed within body portion 20, top flap extensions 5 and 5' may be folded inwardly 90° as shown in FIG. 3. FIG. 3 illustrates a plurality of products 11 packed within body portion 20, top flap extensions being folded over towards each other, and top panel 8 partially attached to the outer surfaces of reinforcing pillars 6 and 6'.

Figure 4:
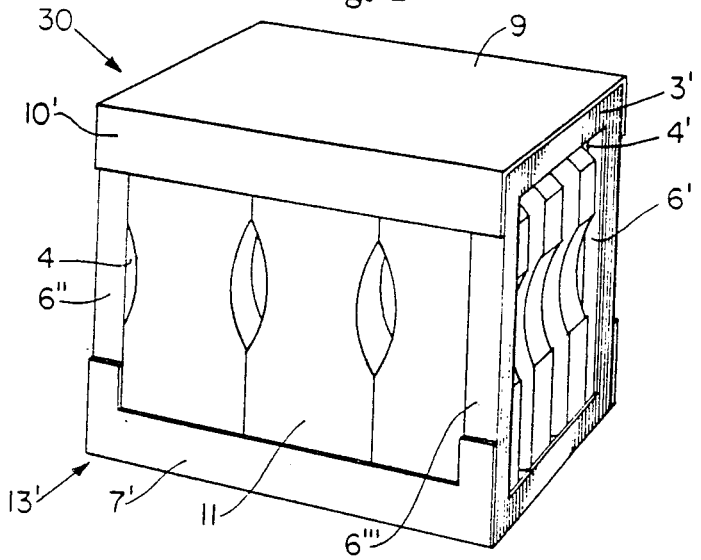
FIG. 4 is a perspective view of the container of FIG. 3 after the top panel has been completely attached thereon.
Figure 5:
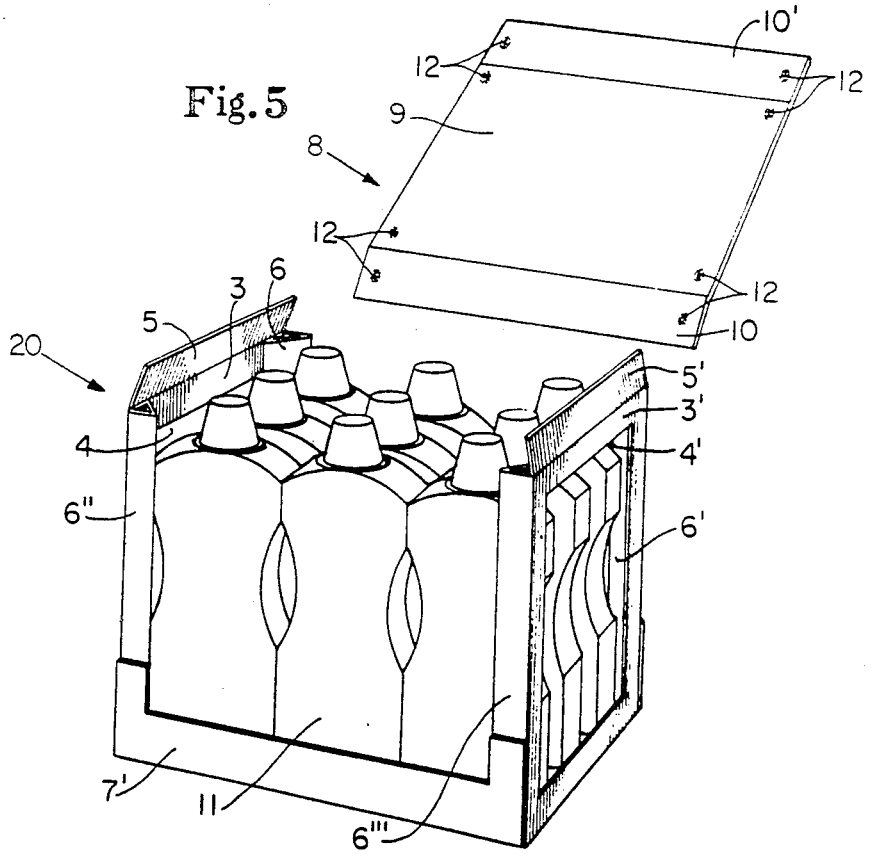
FIG. 5 is a perspective view of the container of FIG. 4 following removal of the top panel.

The completed container 30 is illustrated in FIG. 4. Top panel 8 has been adhesively attached to the outer surfaces of the reinforcing pillars and to the upper surface of top flap extensions 5 and 5', as shown. By attaching top panel 8 to the reinforcing pillars and the top flap extensions as described, additional strength and stability is given to the completed container. It is also evident that by designing top wall extensions 10 and 10' to extend downwardly onto the front and rear portions of container 30, the contained products 11 will be better kept in place within the container and prevented from accidentally falling out of the open portions thereof. In many situations, containers made in accordance with the subject invention provide adequate shipping, handling and display characteristics without a need for additional shrink or stretch-wrapping thereof.

It is preferred that the manner of attachment of top panel 8 be such as to provide for a convenient and easy removal thereof for price marking, display, and/or removal of the individual products 11. It is preferred that individual glue spots 12 be located on the inside of top panel 8 as indicated in FIGS. 1*b* and 3 to optimize adhesive strength versus convenience of removal thereof. It should be understood, however, that other adhesive patterns and/or alternative methods of attaching top panel 8 to body portion 20 can be equally substituted by one of ordinary skill in the art. For example, top flap extensions 5 and 5' could be designed to be easily separated from the balance of left and right sidewall panels 3 and 3', respectively, such as by perforating the hinged connections therebetween. Following removal of top panel 8, reinforcing pillars 6, 6',6'' and 6''' continue to provide adequate strength to body portion 20 to permit convenient display and stacking.

Having shown and described the preferred embodiment of the present invention, further adaptions of the container can be accomplished by appropriate modifications by one of ordinary skill in the art without departing from the scope of the present invention. Accordingly, the scope of the present invention should be considered in terms of the following claims and is understood not to be limited to the details of structure and operation shown and described in the specification and drawings.

We claim:

1. A shipping and display container featuring substantially open sidewall panels, said container comprising:

(a) a body portion, said body portion including a bottom panel, front and rear sidewall panels attached to opposite front and rear edges of said bottom panel, right and left sidewall panels attached to opposite right and left edges of said bottom panel, and four reinforcing corner pillars, said front, rear, right and left sidewall panels having substantial open cutout portions to provide see-through windows therein, and said right and left sidewall panels each having a top flap extension hingedly attached to its upper distal edge, said top flap extensions being folded inwardly 90° in a completed container to facilitate support and attachment of a top panel to said body portion; and (b) a top panel attached to the upper surfaces of said top flap extensions and to the outer surfaces of said reinforcing pillars of said body portion and being easily removable therefrom.

2. The shipping and display container of claim 1, wherein at least said body portion is formed from an integral blank of container material.

3. The shipping and display container of claim 2, wherein said top panel further comprises a top wall portion having a pair of top wall extensions hingedly attached along parallel fold lines to opposite front and rear edges thereof.

4. The shipping and display container of claim 3, wherein said corner pillars further comprise two or more vertical members hingedly connected in seriation along their longitudinally adjacent edges which when folded establish said pillars, said corner pillars each being connected integrally to a longitudinal edge of a front or rear sidewall panel.

5. The shipping and display container of claim 4, wherein a plurality of individual products are contained within said container in one or more rows.

6. A shipping and display container featuring substantially open sidewall panels, said container comprising:

(a) a body portion, said body portion being integrally formed from a single blank of container material and including a bottom panel, front and rear sidewall panels attached to opposite front and rear edges of said bottom panel, right and left sidewall panels attached to opposite right and left edges of said bottom panel, and four reinforcing corner pillars, each of said corner pillars being attached to a longitudinal edge of a front or rear sidewall panel and said front, rear, right and left sidewall panels having substantial open cutout portions to provide see-through windows therein, and said right and left sidewall panels each having a top flap extension hingedly attached to its upper distal edge, said top flap extensions being folded inwardly 90° in a completed container to support attachment of a top panel to said body portion; and (b) a top panel attached to the upper surfaces of said top flap extensions and to the outer surfaces of said reinforcing pillars of said body portion and being easily removable therefrom.

7. The shipping and display container of claim 6, wherein said top panel further comprises a top wall portion having a pair of top wall extensions hingedly attached along parallel fold lines to opposite front and rear edges thereof.

8. The shipping and display container of claim 7, wherein said corner pillars further comprise two or more vertical members hingedly connected in seriation along their longitudinally adjacent edges which when folded establish said pillars, said corner pillars each being connected integrally to a longitudinal edge of a front or rear sidewall panel.

9. The shipping and display container of claim 8, wherein a plurality of individual products are contained within said container in one or more rows.

10. A shipping and display container featuring substantially open sidewall panels, said container comprising:

(a) a body portion formed from an integral blank of container material, said body portion including a bottom panel, front and rear sidewall panels attached to opposite front and rear edges of said bottom panel, right and left sidewall panels attached to opposite right and left edges of said bottom panel, and four reinforcing corner pillars, each corner pillars including two or more vertical members hingedly connected in seriatim along their adjacent longitudinal edges, and each corner pillar being attached to a longitudinal edge of a front or rear sidewall panel, said front, rear, right and left sidewall panels having substantial open cutout portions to provide see-through windows therein, and said right and left sidewall panels each having a top flap extension hingedly attached to its upper distal edge, said top flap extensions being folded inwardly 90° in a completed container to support attachment of a top panel to said body portion; and (b) a top panel attached to the upper surface of said top flap extensions and to the outer surfaces of said reinforcing pillars of said body portion and being easily removable therefrom, said top panel further comprising a top wall portion and a pair of top wall extensions hingedly attached along parallel fold lines to opposite front and rear edges thereof.

11. The shipping and display container of claim 10, wherein said top wall extensions of said top panel extend downwardly from said top wall portion to establish the upper parts of composite front and rear sidewalls of said container.

* * * * *